US006952980B2

(12) United States Patent
Hayashihara et al.

(10) Patent No.: US 6,952,980 B2
(45) Date of Patent: Oct. 11, 2005

(54) PEDAL DEVICE WHEREIN NON-OPERATED POSITION OF OPERATING PORTION IS ADJUSTABLE

(75) Inventors: Takashi Hayashihara, Toyota (JP); Akihiko Fukase, Aichi-ken (JP); Nobuyuki Kikukawa, Okazaki (JP); Hakumi Ishii, Okazaki (JP)

(73) Assignee: Toyoda Iron Works Co., Ltd., Toyota (JP)

( * ) Notice: Subject to any disclaimer, the term of this patent is extended or adjusted under 35 U.S.C. 154(b) by 189 days.

(21) Appl. No.: 10/394,153

(22) Filed: Mar. 24, 2003

(65) Prior Publication Data

US 2004/0040403 A1 Mar. 4, 2004

(30) Foreign Application Priority Data

Aug. 27, 2002 (JP) ..... 2002-246784

(51) Int. Cl.[7] ..... G05G 1/14
(52) U.S. Cl. ..... 74/512; 74/560
(58) Field of Search ..... 74/512, 513, 560

(56) References Cited

U.S. PATENT DOCUMENTS

| | | | | |
|---|---|---|---|---|
| 4,875,385 | A | 10/1989 | Sitrin | |
| 5,010,782 | A | 4/1991 | Asano et al. | |
| 5,460,061 | A | 10/1995 | Redding et al. | |
| 5,996,438 | A | 12/1999 | Elton | |
| 5,996,439 | A | 12/1999 | Elton et al. | |
| 6,178,847 | B1 | 1/2001 | Willemsen et al. | |
| 6,289,761 | B1 | 9/2001 | Reynolds et al. | |
| 6,324,939 | B1 | 12/2001 | Cicotte | |
| 6,367,348 | B1 | 4/2002 | Toelke et al. | |
| 6,367,349 | B1 | 4/2002 | Allen et al. | |
| 6,520,045 | B2 * | 2/2003 | Fukase et al. | 74/512 |
| 6,609,438 | B1 * | 8/2003 | Bigham et al. | 74/560 |
| 2002/0002874 | A1 | 1/2002 | Burton et al. | |
| 2002/0078784 | A1 | 6/2002 | Hayashihara | |
| 2002/0148322 | A1 | 10/2002 | Gmurowski et al. | |
| 2002/0166408 | A1 | 11/2002 | Willemsen | |

FOREIGN PATENT DOCUMENTS

| | | |
|---|---|---|
| FR | 2 739 947 | 4/1997 |
| JP | 63-4312 | 1/1988 |
| WO | WO 00/76924 A1 | 12/2000 |
| WO | WO 01/76924 A2 | 4/2001 |
| WO | WO 02/19051 A1 | 3/2002 |

* cited by examiner

*Primary Examiner*—Thomas R. Hannon
*Assistant Examiner*—Vicky A. Johnson
(74) *Attorney, Agent, or Firm*—Finnegan, Henderson, Farabow, Garrett & Dunner, LLP

(57) ABSTRACT

An adjustable pedal device including (a) a pedal including a pivotal member and a pedal member, the pivotal member being supported by a support shaft disposed on a bracket such that the pivotal member is pivotable about the support shaft, the pedal member being disposed movably relative to the pivotal member in a plane perpendicular to the support shaft, the pedal member having an operating portion at which the pedal member is operated, (b) a guiding device including (i) a pair of guides and a pair of guide pieces which are provided on one and the other of the pivotal and pedal members and which engage each other, to guide a movement of the pedal member relative to the pivotal member, and (c) an adjusting device connecting the pivotal and pedal members and operable to effect the relative movement of the pedal and pivotal members and to hold these members at a desired relative position, and wherein each guide extends linearly, and each guide piece is linearly movable in sliding surface contact with the corresponding guide, and each guide pieces is disposed rotatably about a support pin perpendicular to the sliding plane, the adjusting device being connected to the pedal and pivotal members such that the adjusting device is rotatable relative to these members about respective two connecting pins perpendicular to the sliding plane.

6 Claims, 5 Drawing Sheets

PEDAL DEVICE WHEREIN NON-OPERATED POSITION OF OPERATING PORTION IS ADJUSTABLE

This application is based on Japanese Patent Application No. 2002-246784 filed Aug. 27, 2002, the contents of which are incorporated hereinto by reference.

BACKGROUND OF THE INVENTION

1. Field of the Invention

The present invention relates in general to a pedal device such as a brake pedal device and an accelerator pedal device, and more particularly to an improved adjustable pedal device wherein the non-operated position of an operating portion of a pedal is adjustable.

2. Discussion of Related Art

There is known an adjustable pedal device including (a) a pedal having (i) a pivotal member which is supported by a bracket such that the pivotal member is pivotable about a support shaft, and (ii) a pedal member disposed movably relative to the pivotal member in a sliding plane perpendicular to the support shaft, the pedal member having an operating portion at which the pedal member is operated so that the pedal member and the pivotal member are pivoted together about the support shaft, (b) a guiding device having (i) a pair of guide slots formed through one of the pivotal member and the pedal member, and (ii) a pair of guide pieces which are movable with the other of the pivotal member and the pedal member and which engage the pair of guide slots, respectively, to guide a movement of the pedal member relative to the pivotal member along a predetermined path, and (c) an adjusting device arranged to operatively connect the pedal member and the pivotal member, and operable to move the pedal member relative to the pivotal member so as to establish a desired relative position between the pedal member and the pivotal member, and to hold the pedal member and the pivotal member at the desired relative position. U.S. Pat. No. 6,289,761 discloses an example of an adjustable pedal device of this type for an automotive vehicle, which is constructed as shown in FIG. 5. In this adjustable pedal device, a pivotal member or link 104 supported pivotally by a support shaft or pin 102 fixed to a bracket 100 has two arcuate guide slots 106 and 108 and one linear guide slot 110, and a pedal member or arm 118 is connected to the pivotal member 104 such that the pedal member 118 is movable relative to the pivotal member 104 through guide pieces or pins 112, 114, 116 which are held in sliding engagement with the respective guide slots 106, 108, 110. The pivotal member 104 is provided with an electric motor 122, and a feedscrew or drive screw 120 which is disposed so as to extend in parallel with the linear guide slot 110 and rotated by the electric motor 122. The feedscrew 120 is held in engagement with the guide piece 116. With a rotary motion of the feedscrew 120 by the electric motor 122, the pedal member 118 is moved relative to the pivotal member 104, to a desired position between a fully advanced position (forwardest position) indicated by solid line in FIG. 5, and a fully retracted position (rearmost position) indicated by one-dot chain line. The guide slots 106, 108, 110 and the guide pieces 112, 114, 116 cooperate to constitute a guiding device, while the guide piece 116, the feedscrew 120 and the electric motor 122 cooperate to constitute an adjusting device operable to adjust the non-operated position of the pedal member 118 in the longitudinal direction of the vehicle.

However, this known adjustable pedal device requires high degrees of positioning accuracy (e.g. parallelism) and dimensional accuracy of the components, leading to a problem of a high cost of manufacture, due to the provisions of the three guide slots 106, 108, 110 and the corresponding three guide pieces 112, 114, 116 to guide the pedal member 118, and due to the arcuate shape of the two guide slots 106, 108 and the provision of the feedscrew 120 parallel to the linear guide slot 110 such that the feedscrew 120 is fixed to the pivotal member 104 by fastening means 126 through a suitable mount 124. The known pedal device has another problem that the guide pieces 112, 114, 116 having a cylindrical shape have a comparatively small surface area of contact with the surfaces of the guide slots 106, 108, 110, and an accordingly high pressure of contact with the surfaces of the guide slots due to a reaction force produced upon depression of the pedal member 118, resulting in easy deformation and wearing of the guide pieces 112, 114, 116 and the guide slots 106, 108, 110, and an accordingly low degree of durability of the pedal device.

SUMMARY OF THE INVENTION

It is therefore an object of the present invention to provide a simple and inexpensive adjustable pedal device which includes a pedal member movable relative to a pivotal member and which has a comparatively low pressure of surface contact between guide pieces and guide slots upon depression of the pedal member and which has a high degree of durability.

The above object may be achieved according to any one of the following modes of this invention, each of which is numbered like the appended claims and depends from the other mode or modes, where appropriate, for easier understanding of technical features disclosed in the present application, and possible combinations of those features.

(1) An adjustable pedal device comprising: (a) a support shaft fixedly disposed on a bracket; (b) a pedal including a pivotal member and a pedal member, the pivotal member being supported by the support shaft such that the pivotal member is pivotable about the support shaft, the pedal member being disposed movably relative to the pivotal member in a sliding plane perpendicular to the support shaft, the pedal member having an operating portion at which the pedal member is operated so that the pedal member and the pivotal member are pivoted together about the support shaft; (c) a guiding device having (i) a pair of guides provided on one of the pivotal member and the pedal member, and (ii) a pair of guide pieces which are movable with the other of the pivotal member and the pedal member and which engage the pair of guides, respectively, to guide a movement of the pedal member relative to the pivotal member along a predetermined path; and (d) an adjusting device arranged to operatively connect the pedal member and the pivotal member, and operable to move the pedal member relative to the pivotal member so as to establish a desired relative position between the pedal member and the pivotal member, and to hold the pedal member and the pivotal member at the desired relative position, and wherein each of the pair of guides extends linearly, and each of the pair of guide pieces is linearly movable in sliding surface contact with the corresponding one of the pair of guides, within a predetermined range of distance in a direction parallel to an extension of the corresponding one guide, each guide piece being disposed rotatably about a support pin perpendicular to the sliding plane, the adjusting device being operatively connected to the pedal member and the pivotal member such that the adjusting device is rotatable relative to the pedal member and the pivotal member about respective two connecting pins perpendicular to the sliding plane.

The support shaft about which the pivotal and pedal members are pivotable, the support pin about which each of the pair of guide pieces is rotatable, and the connecting pins about which the adjusting device is rotatable need not be disposed non-rotatably, but may be rotated together with the pivotal and pedal members, or together with each guide piece or the adjusting device.

The adjustable pedal device according to the present invention is suitably used as an adjustable pedal device for an automotive vehicle, such as a brake pedal device, a clutch pedal device, a parking-brake pedal device, and an accelerator pedal device. For instance, the pedal device is arranged to mechanically produce an output force or motion, upon operation of the pedal at its operating portion. The output force or motion of the pedal device is transmitted through a suitable power transmitting member such as a rod or cable to a brake booster, a parking brake or a throttle valve, when the pedal is operated at its operating portion. The pedal device may be arranged to push a brake booster rod or pull an accelerator cable or a parking brake cable. However, the output force or motion of the pedal device may be electrically detected to control a desired device such as a throttle actuator, or an electrically operated device in a hydraulic braking system.

In the adjustable pedal device according to the above mode (1) of this invention, each guide piece is linearly movable in surface contact with the corresponding linearly extending guide, within the predetermined range of distance in the direction parallel to the corresponding linear guide. Further, each guide piece is rotatable about the support pin perpendicular to the sliding plane of the pivotal and pedal members. Accordingly, the pressure of the surface contact between the pair of guide pieces and the pair of guides due to the reaction forces produced during an operation of the pedal can be significantly reduced, irrespective of the position of the pedal member relative to the pivotal member, making it possible to reduce the amounts of deformation or wear of the guides and the guide pieces, and assuring improved stability of the relative movement between the pivotal and pedal members and improved durability of the pedal device. In addition, the adjusting device is connected to the pedal member and the pivotal member such that the adjusting device is rotatable relative to the pedal member and the pivotal member about respective two connecting pins perpendicular to the sliding plane, so that an operation of the adjusting device permits a smooth adjustment of the position of the pedal member relative to the pivotal member. Further, the adjusting device rotatable relative to the pivotal and pedal members requires a relatively low degree of positioning accuracy of the adjusting device with respect to the pair of guides, and a relatively low degree of dimensional accuracy of the related components. The rotatable arrangement of the adjusting device and the provision of the linear or straight guides permit comparatively easy and economical manufacture of the adjustable pedal device.

(2) An adjustable pedal device according to the above mode (1), wherein the pair of guides consist of a pair of linear guide slots each having opposite flat side surfaces, while each of the pair of guide pieces consists of a generally parallelepiped member which has opposite flat side surfaces and which is linearly movable within the corresponding linear slot, with its opposite flat side surfaces held in sliding surface contact with the opposite flat side surfaces of the corresponding linear guide slot.

In the adjustable pedal device according to the above mode (2) of the invention, the pair of guides consist of the two linear guide slots, rather than guide rails or rods, while the pair of guide pieces consist of the two generally parallelepiped members each having opposite flat side surfaces for sliding surface contact with the opposite flat side surfaces of the corresponding linear guide slot. This arrangement of the guiding device permits simpler construction and a lower cost of manufacture of the adjustable pedal device, than a guiding device which uses a pair of guide rails or rods.

While the pair of guides preferably consist of a pair of linear guide slots as described above with respect to the above mode (2) of the invention, it is possible to use a pair of guide rails or rods. It is also possible to use two guides of different types, such as a guide slot and a guide rail.

(3) An adjustable pedal device according to the above mode (2), wherein the pair of linear guide slots are defined by respective first metallic bushings, and the guiding device further includes a second metallic bushing interposed between the generally parallelepiped member of each guide piece and the support pin such that the generally parallelepiped member is rotatable about the support pin through the second metallic bushing.

In the adjustable pedal device according to the above mode (3), each linear guide slot is defined by the first metallic bushing while the generally parallelepiped member of each guide piece is rotatable about the support pin through the second metallic bushing interposed therebetween. This arrangement permits easy, smooth movement and rotation of the guide piece, resulting in reduction of the amounts of wear, operating noise and vibration and further improvement of the durability of the adjustable pedal device.

(4) An adjustable pedal device according to the above mode (2) or (3), wherein the pair of linear guide slots are provided in the pivotal member while the pair of guide pieces are supported by the pedal device through respective two support pins, the adjustable pedal device further comprising a connecting plate fixed to the two support pins such that the pair of guide pieces are sandwiched by and between the pedal member and the connecting plate, and wherein the adjusting device is rotatably connected to the connecting plate through one of the respective two connecting pins.

In the adjustable pedal device according to the above mode (4), the pedal member is provided with the guide pieces, and the connecting plate and the pedal member are fixed together with the two support pins such that the guide pieces are sandwiched by and between the connecting plate and the pedal member. The adjusting device is connected to the connecting plate, to move the pedal member relative to the pivotal member. These arrangements permit higher stability of the attitude of the guide pieces and assure a smoother movement of the pedal member relative to the pivotal member while being guided by the mutually engaging guide pieces and guide slot, than an arrangement wherein the guide pieces are supported by the pedal member in a cantilever fashion.

Although the pair of guides in the form of the linear guide slots are preferably provided in the pivotal member while the pair of guide pieces are provided on the pedal member, as described above with respect to the above mode (4), the pedal member and the pivotal member may be respective provided with the pair of guides and the pair of guide pieces.

(5) An adjustable pedal device according to any one of the above modes (1)–(4), wherein the adjusting device includes (a) an electrically operated rotary drive device connected to one of the pivotal member and the pedal member through one of the respective two connecting pins, (b) a nut member connected to the other of the pivotal member and the pedal member through the other of the respective two connecting pins, and (c) a feedscrew connected to the electrically operated rotary drive device such that the feedscrew is rotatable about its axis by the electrically operated rotary drive device and such that the axis of the feedscrew is substantially parallel to one of the pair of guides, the feedscrew being held in engagement with the nut member.

In the adjustable pedal device according to the above mode (5), the pedal member is moved relative to the pivotal member to a desired position, by a rotary motion of the feedscrew by the electrically operated rotary drive device, so that the non-operated position of the pedal pad can be easily and efficiently adjusted by simply controlling the electrically operated rotary drive device.

While the adjusting device preferably includes a feedscrew rotated by an electrically operated rotary drive device and engaging a nut member, as described above with respect to the above mode (5), the adjusting device may use a rack-and-pinion mechanism, a chain mechanism, a toggle mechanism, or any other suitable mechanism for moving the pedal member relative to the pivotal member. Although the adjusting device is preferably arranged to continuously change the position of the pedal member relative to the pivotal member, the adjusting device may be arranged to move the pedal member to a selected one of a plurality of positions relative to the pivotal member. Further alternatively, the adjusting device may be a device which is manually operated to establish a desired relative position between the pivotal member and the pedal member. In this case, the pivotal and pedal members may be locked at the manually established relative position with suitable locking means.

(6) An adjustable pedal device according to any one of the above modes (1)–(5), which is to be installed on a vehicle such that an axis of the support shaft is substantially parallel to a lateral direction of the vehicle, and such that the pedal member is movable relative to the pivotal member, so that the operating portion of the pedal member is moved in a longitudinal direction of the vehicle.

In the adjustable pedal device for a vehicle constructed according to the above mode (6), the position of the operating portion of the pedal member can be adjusted in the longitudinal direction of the vehicle, so that any operator of the vehicle can easily operate the pedal at the operating portion.

(7) An adjustable pedal device according to any one of the above modes (1)–(6), wherein the pair of guides of the guiding device extend in respective two directions intersecting each other such that the movement of the pedal member relative to the pivotal member causes a change of an attitude of the operating portion.

In the adjustable pedal device according to the above mode (7), the two guides are formed so as to extend in the respective two directions that intersect each other, so that the attitude or posture of the operating portion of the pedal changes as the pedal member is moved relative to the pivotal member. This arrangement permitting an adjustment of the attitude of the operating portion facilitates an operation or depression of the pedal at its operating portion.

The adjustable pedal device according to the above mode (6) is adapted to be used on a vehicle, for adjusting the non-operated position of the pedal member, while the adjustable pedal device according to the above mode (7) is arranged to change the attitude or posture of the operating portion (angle of inclination of the operating surface of the operating portion with respect to the horizontal or vertical plane) as the pedal member is moved relative to the pivotal member by the adjusting device. However, the adjustable pedal device may be arranged to adjust or move the position of the operating portion in the vertical direction, or to translate the operating portion with the two guides formed so as to extend in parallel with each other. The adjustable pedal device may be used for various purposes, and for any machines, devices or equipment other than a vehicle. In the adjustable pedal device according to the above mode (7) wherein the two guides extend in the respective two directions intersecting each other, the two guides need not be formed continuously with each other, namely, need not be provided by a single guide such as an L-shaped guide. That is, the two guides may be mutually separate guides formed such that lines of extension of the two guides intersect each other.

Where the adjustable pedal device according to the above mode (7) is used for a vehicle, the pair of guides are arranged to cause a downward movement of the operating portion of the pedal and rotation of the operating surface of the operating portion so as to be gradually inclined upwards as the position of the operating portion is moved toward the operator's seat as a result of the movement of the pedal member relative to the pivotal member by the adjusting device. However, the pair of guides may be arranged such that the vertical position of the operating portion is kept constant irrespective of the movement of the operating portion in the longitudinal direction of the vehicle. Alternatively, the pair of guides may be arranged such that the operating portion is moved upwards as the operating portion is moved toward the operator's seat.

BRIEF DESCRIPTION OF THE INVENTION

The above and other objects, features, advantages and technical and industrial significance of the present invention will be better understood by reading the following detailed description of a preferred embodiment of the invention, when considered in connection with the accompanying drawings, in which.

DETAILED DESCRIPTION OF THE PREFERRED EMBODIMENT

Figure 1:
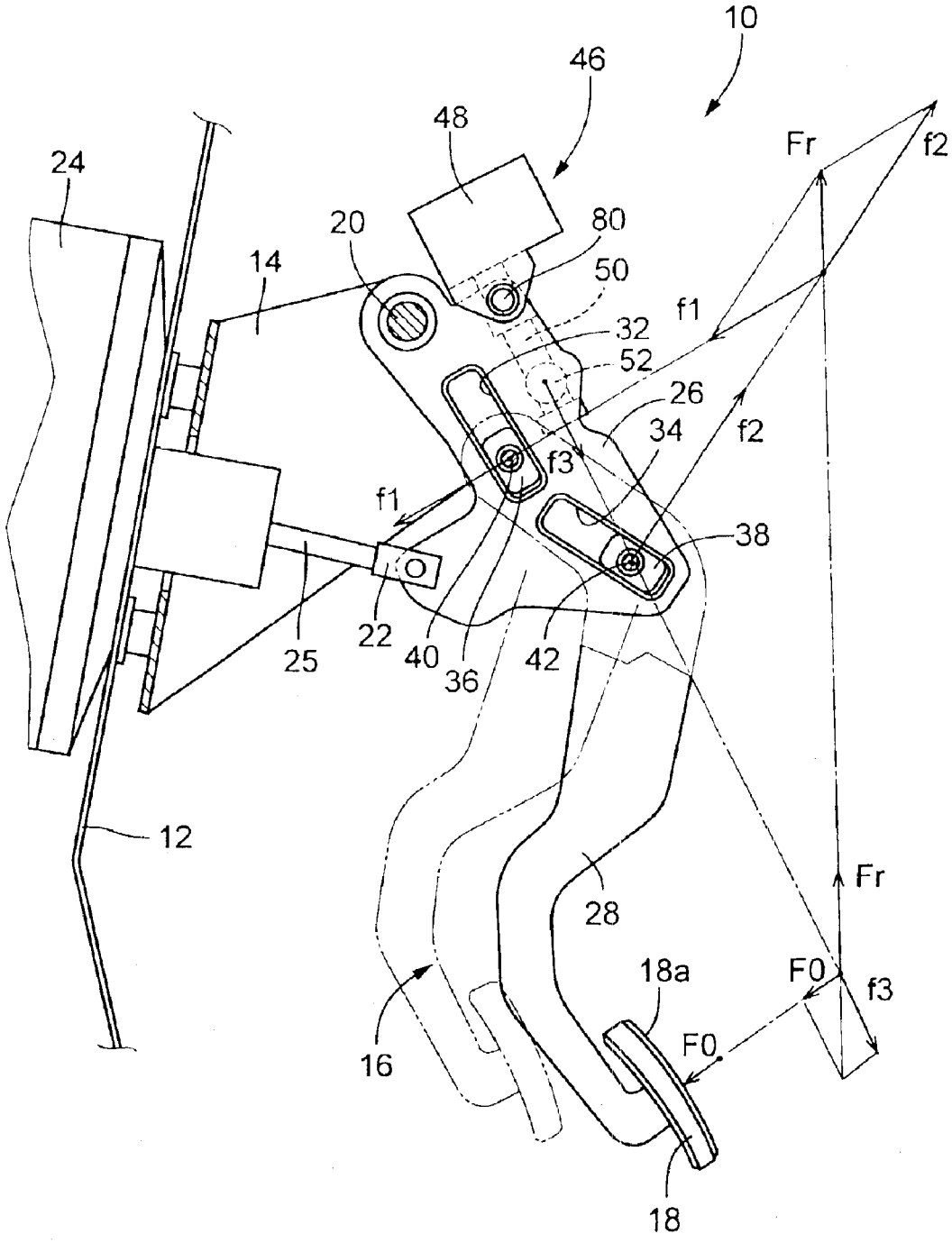
FIG. 1 is a partly cut-away left side elevational view of a brake pedal device for an automotive vehicle, which is constructed according to one embodiment of this invention.
Figure 2:
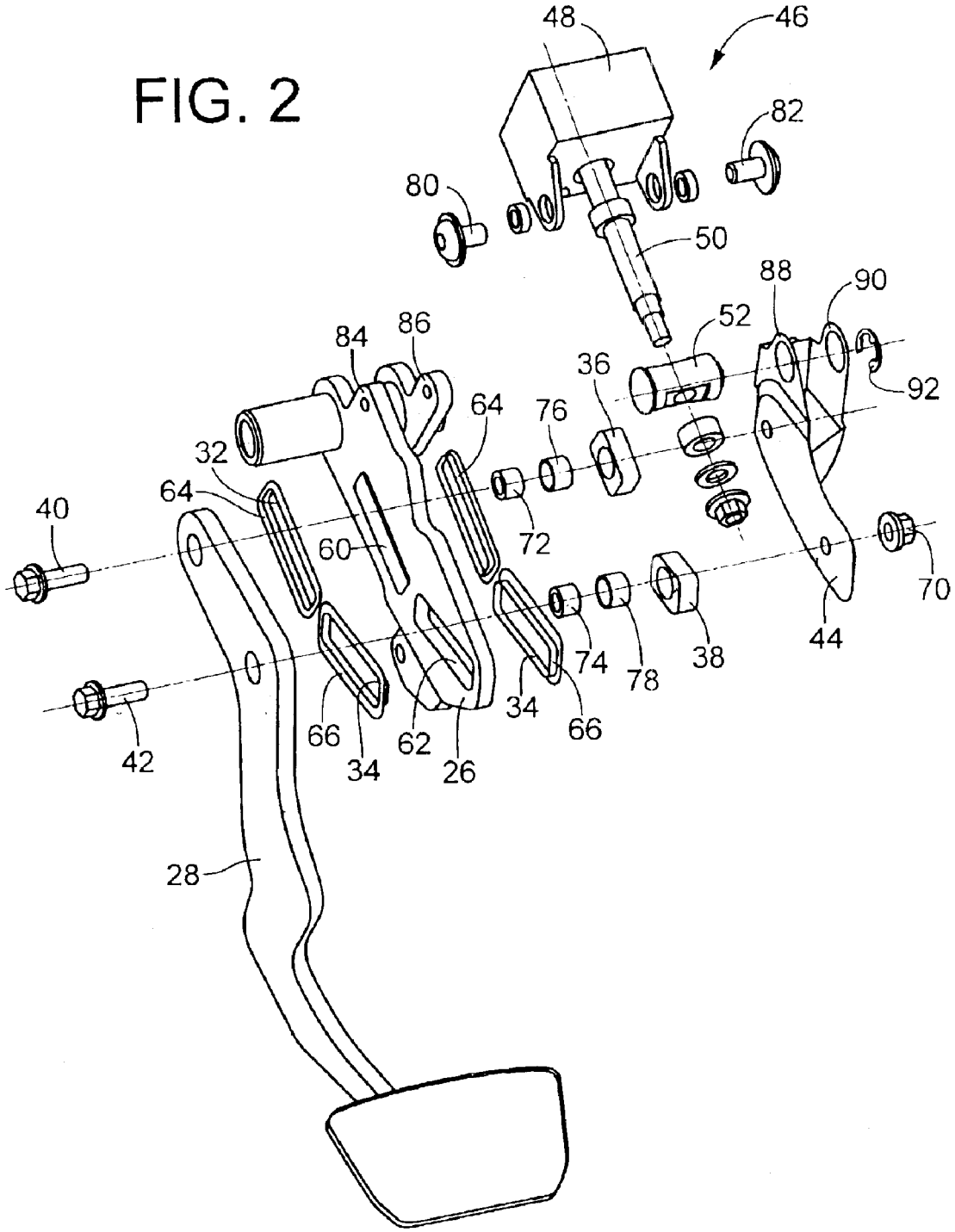
FIG. 2 is a exploded perspective view showing components of the brake pedal device of FIG. 1.
Figure 3:
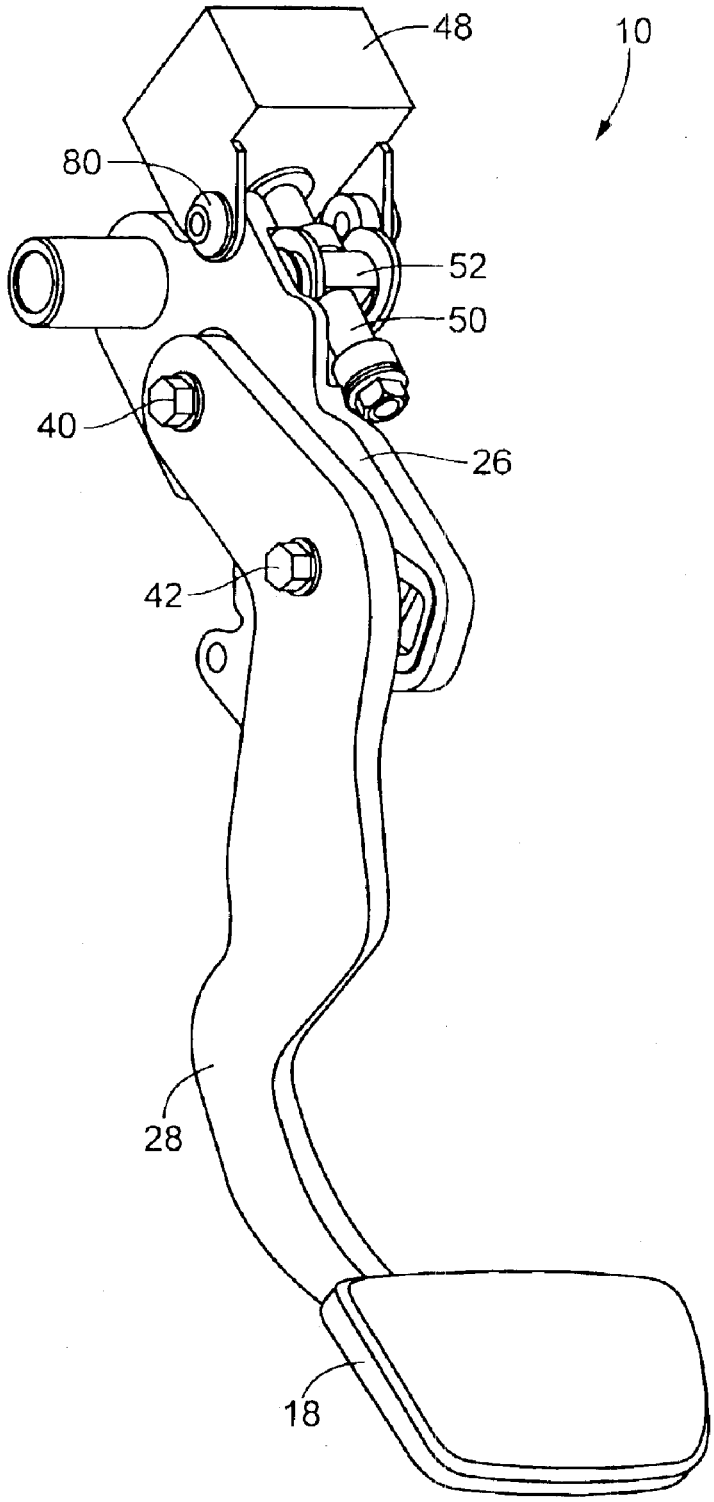
FIG. 3 is a perspective view of the brake pedal device of FIG. 1 as seen obliquely from its left-hand side.
Figure 4:
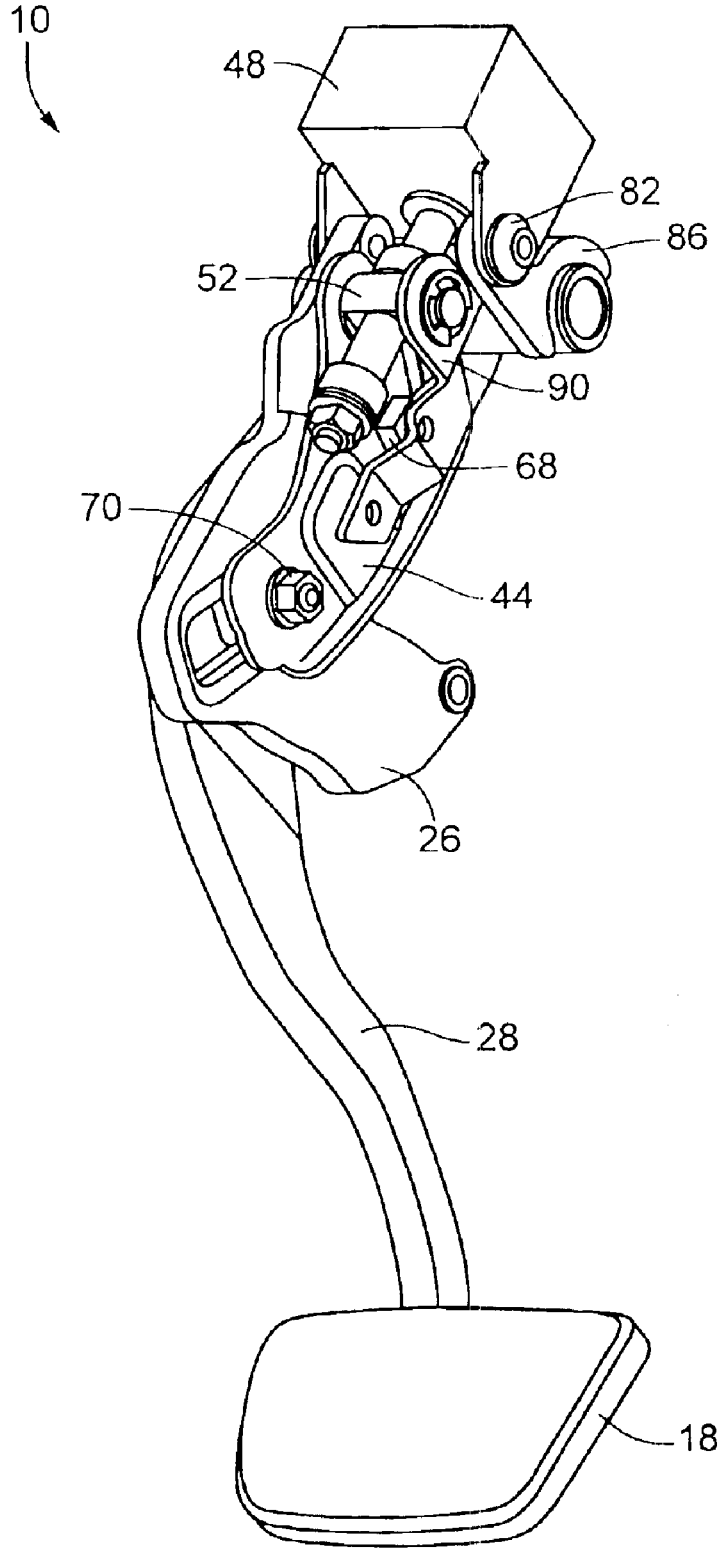
FIG. 4 is a perspective view of the brake pedal device of FIG. 1 as seen obliquely from its right-hand side.
Figure 5:
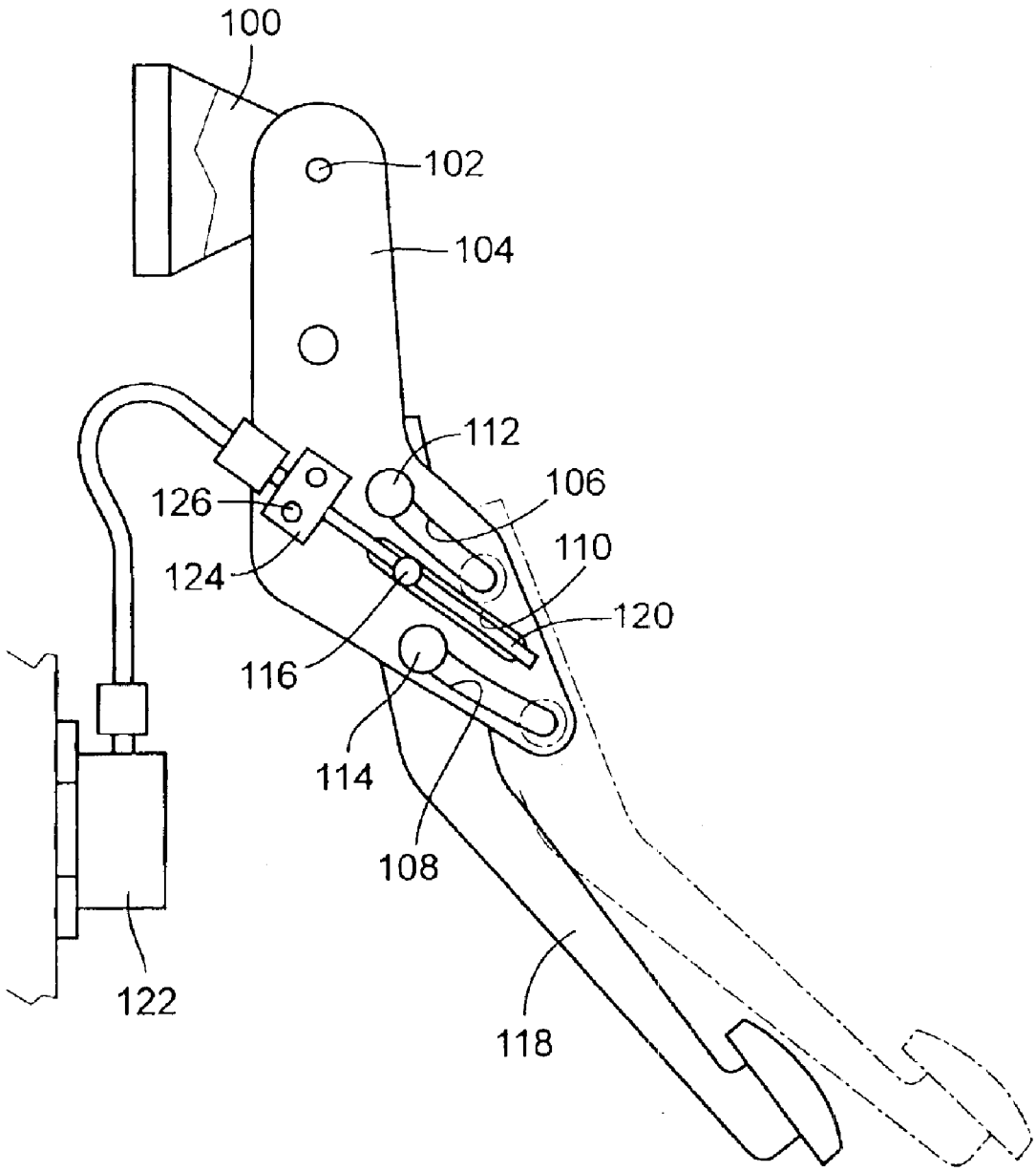
FIG. 5 PRIOR ART
FIG. 5 is a view illustrating an example of an adjustable pedal device wherein the non-operated position of a pedal is adjustable in the longitudinal direction of a vehicle.

Referring to the partly cut-away left side elevational view of FIG. 1, the exploded perspective view of FIG. 2 and the perspective views of FIGS. 3 and 4, there is shown an adjustable pedal device in the form of a brake pedal device 10 which is constructed according to one embodiment of this invention and installed on an automotive vehicle. In FIG. 1, the left portion of the view corresponds to the front side of the vehicle, while the right side portion corresponds to the rear side of the vehicle. Namely, a vehicle operator's seat is located on the right side of the elevational view of FIG. 1.

The brake pedal device 10 is mounted on a bracket 14 fixed on a body 12 (e.g., a dash panel) of the vehicle, and includes a brake pedal 16 having an operating portion in the form of a pedal pad 18 at its lower end. When the brake pedal 16 is depressed at its pedal pad 18 while the brake pedal 16 is placed at the presently selected non-operated or original position of FIG. 1, the brake pedal 16 is pivoted clockwise (as seen in FIG. 1) about a support shaft 20 fixedly disposed on the bracket 14, so as to push or advance a rod 25 of a brake booster 24 (not shown), which is connected to the brake pedal 16 through a clevis member 22. As a result of an advancing movement of the booster rod 25, the brake booster 24 is activated to boost an operating force acting on the pedal pad 18 of the brake pedal 16, and apply its output to an input member of a master cylinder (not shown), so that a working fluid in the master cylinder is pressurized by a pressurizing piston to activate hydraulic service brakes of the vehicle. In the present embodiment, the rod 25 of the brake booster 24 serves as a power transmitting member for transmitting the operating force of the brake pedal 16 to the brake booster 24. The support shaft 20 is fixed to the bracket 14 such that the centerline or axis of the support shaft 20 is substantially parallel to the horizontal direction and to the lateral or transverse direction of the vehicle (substantially perpendicular to the longitudinal or running direction of the vehicle).

The brake pedal 16 consists of upper and lower members in the form of an upper pivotal member 26 and a lower pedal member 28. The pivotal member 26 is supported by the support shaft 20, pivotally about the support shaft 20. The pedal member 28 has the pedal pad 18 formed integrally at its lower end. The booster rod 25 is connected to the pivotal member 26. While the brake pedal 16 is released, the brake pedal 16 is returned by the booster rod 25 and a return spring (not shown), while being pivoted counterclockwise about the support shaft 20, and held at the non-operated position under a biasing action of the return spring. The non-operated position of the brake pedal 16 (more precisely, the non-operated position of the pivotal member 26) is determined by a suitable stop device (not shown) or by a distance of extension of the booster rod 25 from the brake booster 24.

Each of the pivotal and pedal members 26, 28 of the brake pedal 16 is a generally planar member (except the pedal pad 18) whose plane is substantially perpendicular to the axis of the support shaft 20 and substantially parallel to the longitudinal direction of the vehicle, so that the planes of the pivotal and pedal members 26, 28 are substantially vertical planes (parallel to the plane of the side elevational view of FIG. 1). The pedal member 28 is movable relative to the pivotal member 26 in a substantially vertical sliding plane parallel to their planes indicated above, so that the non-operated position of the pedal pad 18 of the pedal member 26 is movable or adjustable in the longitudinal direction of the vehicle, to a desired position selected between a fully advanced or forwardest position indicated by two-dot chain line in FIG. 1 and a fully retracted or rearmost position indicated by solid line in FIG. 1. The perspective views of FIGS. 3 and 4 shows the brake pedal device 10 when the pedal pad 18 is located at its fully advanced position.

The pivotal member 26 has straight guides in the form of two straight or linear elongate guide slots 32, 34 formed therethrough, while the pedal member 28 are provided with two guide pieces 36, 38 which are held in engagement with the respective two guide slots 32, 34 and are slidably and linearly movable within the respective linear guide slots 32, 34, so that the pedal member 28 is movable relative to the pivotal member 26 along a predetermined path, with the sliding movements of the guide pieces 36, 38 within the respective guide slots 32, 34, whereby the non-operated position of the pedal pad 18 at the lower end of the pedal member 28 is adjustable or movable in the longitudinal direction of the vehicle. As shown in FIG. 1, the two guide slots 32, 34 are formed such that straight lines of extension of the two guide slots 32, 34 intersect each other, so that as the pedal pad 18 is moved in the rearward direction toward the operator's seat of the vehicle, the pedal pad 18 is lowered while an operating surface 18*a* of the pedal pad 18 is gradually inclined in the upward direction (rotated counterclockwise about a horizontal axis, as seen in FIG. 1, so as to face relatively upwards at the fully retracted position). Each of the two guide pieces 36, 38 is a rectangular or parallelepiped member having a width substantially equal to the width of the linear guide slots 32, 34, so that each guide piece 36, 38 is linearly guided by the opposite flat side surfaces of the corresponding guide slot 32, 34, in the longitudinal direction of the guide slot 32, 34, while each guide piece 36, 38 is held in surface contact with the opposite flat side surfaces of the corresponding guide slot 32, 34. The pedal member 28 is provided with two support pins 40, 42 such that the support pins 40, 42 extend in a direction perpendicular to the above-indicated sliding plane in which the pivotal and pedal members 26, 28 are movable relative to each other. The two guide pieces 36, 38 are supported by the respective support pins 40, 42 such that the guide pieces 36, 38 are pivotable about the respective support pins 40, 42. It will be understood that the elongate holes 32, 34 and the guide pieces 36, 38 cooperate to constitute a guiding device for guiding a relative movement of the pivotal and pedal members 26, 28.

As most clearly shown in FIG. 2, the pivotal member 26 has two through-holes 60, 62 corresponding to the two guide slots 32, 34. A first pair of metallic bushings 64, 64 in the form of rectangular frames are press-fitted into the through-hole 60 in the respective opposite directions. Similarly, a second pair of metallic bushings 66, 66 in the form of rectangular frames are press-fitted into the through-hole 62. The two bushings 64, 64 cooperate to define the linear guide slot 32, while the two bushings 66, 66 cooperate to define the linear guide slot 34. Each of the two guide slots 32, 34 has opposite flat side surfaces for contact with the corresponding opposite flat side surfaces of the corresponding guide piece 36, 38, for guiding the guide piece 36, 38 in the longitudinal direction of the elongate guide slot 32, 34. Each of the support pins 40, 42 has an externally threaded end portion. A connecting plate 44 is fixed to the pedal member 28 by the two support pins 40, 42 and corresponding two nuts 68, 70 which are screwed on the externally threaded end portions of the support pins 40, 42. Described more specifically, such that a part of the pivotal member 26 in which the guide slots 32, 34 are formed to accommodate the guide pieces 36, 38 is sandwiched by and between the connecting plate 44 and the pedal member 28. The support pins 40, 42 extend through the pedal member 28, circular bores formed through the guide pieces 36, 38, and the connecting plate 44. With the nuts 68, 70 screwed on the threaded end portions of the support pins 40, 42, the pedal member 28, pivotal member 26 and connecting plate 44 are assembled together. As shown in FIG. 4, the nut 68 corresponding to the support pin 40 is welded to the connecting plate 44.

A collar 72, 74 is disposed in the bore of each guide piece 36, 38, and is sandwiched by and between the pedal member 28 and the connecting plate 44, so as to establish a desired spacing distance between the pedal member 28 and the connecting plate 44. The support pins 40, 42 extend through the collars 72, 74 such that the collars 72, 74 permit the guide pieces 36, 38 to be rotatable about the support pins 40,

42. Between the inner circumferential surface of the bore of each guide piece 36, 38 and the outer circumferential of the collar 72, 74, there is interposed a metallic cylindrical bushing 76, 78 such that the bushing 76, 78 is press-fitted in the bore and such that the collar 72, 74 is rotatable in sliding contact with the inner circumferential surface of the bushing 76, 78. The metallic cylindrical bushing 76, 78 serves as a second metallic bushing as distinguished from first metallic bushings in the form of the metallic rectangular bushings 64, 66 described above.

The brake pedal device 10 includes an adjusting device 46 which operatively connects the connecting plate 44 and the pivotal member 26 of the brake pedal 16. The adjusting device 46 includes an electrically operated rotary drive device 48 supported by the pivotal member 26, a feedscrew 50 rotated about its axis by the rotary drive device 48, and a nut member 52 which is supported by the connecting plate 44 and which is held in engagement with the feedscrew 50. The electrically operated rotary drive device 48 includes an electric motor and a speed reducing mechanism, and is connected to mounting portions 84, 86 of the pivotal member 26 through respective connecting pins 80, 82 that are parallel to the support shaft 20, that is, perpendicular to the above-indicated sliding plane of the pivotal and pedal members 26, 28. Thus, the rotary drive device 48 is supported by the pivotal member 26 that the rotary drive device 48 is pivotable about the connecting pins 80, 82. These connecting pins, 80, 82, which may be rivets, serve as a connecting pin through which the rotary drive device 48 is pivotally or rotatably connected to the pivotal member 26. On the other hand, the nut member 52 is a cylindrical member which has a threaded or tapped hole formed so as to be perpendicular to its centerline or axis. The nut member 52 is mounted on mounting ports 88, 90 of the connecting plate 44 and retained by a retainer ring 92 such that the axis of the nut member 52 is perpendicular to the above-indicated sliding plane and such that the nut member 52 is rotatable about its axis. It will be understood that the nut member 52 serves as another connecting pin through which the adjusting device 46 is rotatably connected to the connecting plate 44.

The feedscrew 50 described above is held in engagement with the nut member 52, while extending substantially in parallel with the line of extension of the linear guide slot 32. The rotary drive device 48 is bidirectionally operable by the operator of the automotive vehicle through a suitable switching device. A rotational movement, in either direction, of the feedscrew 40 by the operation of the rotary drive device 48 causes a movement of the nut member 52 in the axial direction of the feedscrew 50, so that the connecting plate 44 is moved relative to the pivotal member 26, with a change of a distance between the connecting pins 80, 82 and the nut member 52. Accordingly, the guide pieces 36, 38 are slidably and linearly moved within the linear guide slots 32, 34, while the pedal member 28 is moved with the connecting plate 44 relative to the pivotal member 26, so that the non-operated position of the pedal pad 18 serving as the operating portion of the pedal 16 is adjusted or moved in the longitudinal direction of the vehicle. The rotary drive device 48 is turned off when the pedal pad 18 of the pedal member 28 moved relative to the pivotal member 26 has been moved to the desired non-operated position.

Arrows indicated in FIG. 1 in connection with the respective components of the pedal device 10 show an equilibrium of forces during an operation of the brake pedal 16 while the pedal pad 18 is located at the fully retracted or rearmost position indicated in solid line. References characters "F0", "f1", "f2", "f3" and "fr" represent the following parameters:

F0=operating force (depression force) acting on the pedal pad 18;

f1=reaction force acting on the guide piece 36;

f2=reaction force acting on the guide piece 38;

f3=reaction force acting on the nut member 52; and fr=resultant of the forces f1 and f2.

Since the guide pieces 36, 38 are rotatable about the respective support pins 40, 42 perpendicular to the above-indicated sliding plane, the reaction forces f1 and f2 act on the respective guide pieces 36, 38 in respective first and second directions perpendicular to the longitudinal directions of the respective linear guide slots 32, 34, so that each of the guide pieces 36, 38 is forced at one of its opposite flat side surfaces against the corresponding one of the opposite flat surfaces of the guide slot 32, 34 in the above-indicated first and second directions. Further, the reaction force f3 acts on the nut member 52 in the axial direction of the feedscrew 50, since the connecting pins 80, 82 about which the rotary drive device 48 is pivotable relative to the pivotal member 26, and the axis of the nut member 52 about which the nut member 52 is rotatable relative to the connecting plate 44 are both perpendicular to the sliding plane of the pivotal and pedal members 26, 28. Accordingly, the rotary motion of the feedscrew 50 permits a smooth movement of the nut member 52 in the axial direction of the feedscrew 50.

In the adjustable pedal device 10 according to the present embodiment of the invention, the pedal member 28 is operatively connected to the pivotal member 26 through the two pairs of guide slots 32, 34 and guide pieces 36, 38, and is moved relative to the pivotal member 26 by the adjusting device 46, to move or adjust the non-operated position of the pedal pad 18 of the pedal member 28 in the longitudinal direction of the vehicle. Further, the two guide slots 32, 34 whose lines of extension intersect each other cause the vertical position and attitude of the pedal pad 18 to change as the pedal pad 18 is moved in the longitudinal direction of the vehicle, so that the brake pedal 16 can be easily operated at its pedal pad 18, irrespective of the presently selected or established non-operated position of the pedal pad 18. That is, the present brake pedal device 10 is arranged such that as the pedal pad 18 is moved in the rearward direction toward the operator's seat of the vehicle, the pedal pad 18 is lowered while its operating surface 18*a* is gradually inclined upwards or rotated counterclockwise about a horizontal axis, as seen in FIG. 1, so as to face relatively upwards at the fully retracted position. This arrangement facilitates an operation of the brake pedal 16 by a relatively short vehicle operator who usually likes the pedal pad 18 to be located at a relatively rear non-operated position near the operator's seat.

Further, each guide piece 36, 38 in the form of a generally rectangular or parallelepiped member having the opposite parallel flat side surfaces is linearly and slidably moved within the corresponding linear guide slot 32, 34 while the guide piece 36, 38 is held in surface contact with the opposite parallel flat side surfaces of the guide slot 32, 34, owing to the arrangement that permits the guide pieces 36, 38 to be rotatable about the support pins 40, 42 perpendicular to the sliding plane. Accordingly, the reaction forces f1 and f2 act on the guide pieces 36, 38 in the directions perpendicular to the contacting surfaces of the guide slots 32, 34 and guide pieces 36, 38 during an operation of the brake pedal 16, irrespective of the position of the pedal member 28 relative to the pivotal member 26. Further, the pressure of the surface contact of the guide pieces 36, 38 with the guide slots 32, 34 can be significantly reduced, making it possible to reduce the amounts of deformation or wear of the guide slots 32, 34 and guide pieces 36, 38, and assuring improved stability of adjustment of the relative position between the pivotal and pedal members 26, 28 and improved durability of the pedal device 10.

In addition, the adjusting device 46 is connected to the pedal member 28 (connecting plate 44) and the pivotal member 26 such that the adjusting device 46 is pivotable or rotatable relative to the pedal member 28 and the pivotal member 28 about respective connecting pins perpendicular to the sliding plane, so that the rotary motion of the feedscrew 50 permits a smooth movement of the nut member 52 in the axial direction of the feedscrew 50 when the non-operated position of the pedal member 28 is adjusted by the adjusting device 46. Further, the adjusting device 46 pivotable or rotatable relative to the pivotal and pedal members 26, 38 requires a lower degree of positioning accuracy (parallelism) of the adjusting device 46 with respect to the guide slot 32 (e.g., required parallelism of the feedscrew 50 with respect to the guide slot 32), and a lower degree of dimensional accuracy of the related components, than an adjusting device whose feedscrew is held parallel to the guide slot 32. The pivotable arrangement of the rotary drive device 46 and the provision of the linear or straight guide slots 32, 35 permit comparatively easy and economical manufacture of the adjustable pedal device 10.

The provision of the two guides in the form of the two linear guide slots 32, 34 formed through the pivotal member 26, rather than guide rails or rods, permits constructional simplification and further reduction of the cost of manufacture of the pedal device 10.

Further, the pedal member 28 is provided with the guide pieces 36, 38, and the connecting plate 44 and the pedal member 28 are fixed together with the two support pins 40, 42 such that the guide pieces 36, 38 are sandwiched by and between the connecting plate 44 and the pedal member 28. The adjusting device 46 is connected to the connecting plate 44, to move the pedal member 28 relative to the pivotal member 26. These arrangements permit higher stability of the attitude of the guide pieces 36, 38 and assure a smoother movement of the pedal member 28 relative to the pivotal member 26 while being guided by the mutually engaging guide pieces 36, 38 and guide slots 32, 34, than an arrangement wherein the guide pieces are supported by the pedal member in a cantilever fashion.

In addition, the metallic bushings 64, 66 press-fitted in the through-holes 60, 62 in the pivotal member 26 provide the guide slots 32, 34, while the metallic bushings 76, 78 are press-fitted in the bores of the guide pieces 36, 38, so as to permit the guide pieces 36, 38 to be rotated on the support pins 40, 42. These arrangements permit smooth movements of the guide pieces 36, 38 within the guide slots 32, 34 and smooth rotation of the guide pieces 36, 38 relative to the support pins 40, 42, resulting in reduction of the amounts of wear, operating noise and vibration and further improvement of the durability of the pedal device 10.

Further, the pedal member 28 is moved relative to the pivotal member 26 to a desired position, by a rotary motion of the feedscrew 50 by the electrically operated rotary drive device 48, so that the non-operated position of the pedal pad 18 can be easily and efficiently adjusted in the longitudinal direction of the vehicle, by simply operating a suitable switching device to control the electrically operated rotary drive device 48.

While the presently preferred embodiment of this invention has been described in detail by reference to the drawings, for illustrative purpose only, it is to be understood that the present invention may be embodied with various other changes, modifications and improvements, which may occur to those skilled in the art, in the light of the technical teachings of the present invention which have been described.

What is claimed is:

1. An adjustable pedal device comprising:

a support shaft fixedly disposed on a bracket;

a pedal including a pivotal member and a pedal member, said pivotal member being supported by said support shaft such that said pivotal member is pivotable about said support shaft, said pedal member being disposed movably relative to said pivotal member in a sliding plane perpendicular to said support shaft, said pedal member having an operating portion at which said pedal member is operated so that said pedal member and said pivotal member are pivoted together about said support shaft;

a guiding device including (i) a pair of guides provided on said pivotal member, and (ii) a pair of guide pieces which are movable with said pedal member and which engage said pair of guides, respectively, to guide a movement of said pedal member relative to said pivotal member along a predetermined path, each of said pair of guides extending linearly, and each of said pair of guide pieces being linearly movable in sliding surface contact with the corresponding one of said pair of guides, within a predetermined range of distance in a direction of extension of said corresponding one guide, said pair of guide pieces being supported by said pedal member through respective two support pins perpendicular to said sliding plane and disposed rotatably relative to said pedal member about axes of said respective two support pins;

a connecting plate fixed to said two support pins such that said pair of guide pieces are sandwiched by and between said pedal member and said connecting plate; and an adjusting device arranged to operatively connect said pedal member and said pivotal member, and operable to move said pedal member relative to said pivotal member so as to establish a desired relative position between said pedal member and said pivotal member, and to hold said pedal member and said pivotal member at said desired relative position, said adjusting device being operatively connected to said pedal member and said pivotal member such that said adjusting device is rotatable relative to said pedal member and said pivotal member about axes of respective first and second connecting pins perpendicular to said sliding plane, and rotatably connected to said connecting plate through said first connecting pin.

2. An adjustable pedal device according to claim 1, wherein said pair of guides consist of a pair of linear guide slots each having opposite flat side surfaces, while each of said pair of guide pieces consists of a generally parallelepiped member which has opposite flat side surfaces and which is linearly movable within the corresponding linear slot, with its opposite flat side surfaces held in sliding surface contact with the opposite flat side surfaces of said corresponding linear guide slot.

3. An adjustable pedal device according to claim 2, wherein said pair of linear guide slots are defined by respective first metallic bushings, and said guiding device further includes a second metallic bushing interposed between said generally parallelepiped member of said each guide piece and said support pin such that said generally parallelepiped member is rotatable about said support pin through said second metallic bushing.

4. An adjustable pedal device according to claim 1, wherein said adjusting device includes (a) an electrically operated rotary drive device connected to one of said pivotal member and said pedal member through one of said respective two connecting pins, (b) a nut member connected to the other of said pivotal member and said pedal member through the other of said respective two connecting pins, and (c) a feedscrew connected to said electrically operated rotary drive device such that said feedscrew is rotatable about its axis by said electrically operated rotary drive device and such that the axis of said feedscrew is substantially parallel to one of said pair of guides, said feedscrew being held in engagement with said nut member.

5. An adjustable pedal device according to claim 1, which is to be installed on a vehicle such that an axis of said support shaft is substantially parallel to a lateral direction of the vehicle, and such that said pedal member is movable relative to said pivotal member, so that said operating portion of said pedal member is moved in a longitudinal direction of the vehicle.

6. An adjustable pedal device according to claim 1, wherein said pair of guides of said guiding device extend in respective two directions intersecting each other such that the movement of said pedal member relative to said pivotal member causes a change of an attitude of said operating portion.

* * * * *